US005615761A

United States Patent [19]

Draghetti et al.

[11] Patent Number: 5,615,761

[45] Date of Patent: Apr. 1, 1997

[54] UNIT FOR TRANSFERRING CIGARETTE PORTIONS FROM A DUAL ROD CIGARETTE MANUFACTURING MACHINE TO A FILTER ASSSEMBLY MACHINE

[75] Inventors: Fiorenzo Draghetti, Medicina; Massimo Sartoni, Bologna, both of Italy

[73] Assignee: G.D Societá per Azioni, Bologna, Italy

[21] Appl. No.: 445,052

[22] Filed: May 19, 1995

[30] Foreign Application Priority Data

May 20, 1994 [IT] Italy ..... BO94A0235
May 3, 1995 [IT] Italy ..... BO95A0195

[51] Int. Cl.[6] ..... B65G 29/00

[52] U.S. Cl. ..... 198/441; 198/457

[58] Field of Search ..... 198/457, 427, 198/436, 441; 131/94, 84.1

[56] References Cited

U.S. PATENT DOCUMENTS 4,418,705 12/1983 Seragnoli ..... 131/84 R
4,562,916 1/1986 Filter ..... 198/432
4,925,004 5/1990 Menge ..... 198/457
5,033,482 7/1991 Belvederi et al. ..... 131/94

FOREIGN PATENT DOCUMENTS 5254641 10/1993 Japan ..... 198/457
2149642 6/1985 United Kingdom .

*Primary Examiner*—Kenneth Noland
*Attorney, Agent, or Firm*—Marshall, O'Toole, Gerstein, Murray & Borun

[57] ABSTRACT

A unit for transferring cigarette portions from a dual rod cigarette manufacturing machine to a filter assembly machine; the transfer unit presenting a launching device for successively receiving pairs of cigarette portions arranged side by side and traveling in an axial direction, and for simultaneously feeding the portions in each pair—still substantially axially, but imparting to them a transverse component—into respective adjacent seats of a conveyor device wherein the seats for receiving the cigarette portions are parallel to the cigarette portions, and travel crosswise to the traveling direction of the cigarette portions.

15 Claims, 5 Drawing Sheets

UNIT FOR TRANSFERRING CIGARETTE PORTIONS FROM A DUAL ROD CIGARETTE MANUFACTURING MACHINE TO A FILTER ASSSEMBLY MACHINE

BACKGROUND OF THE INVENTION

The present invention relates to a unit for transferring cigarette portions from a dual rod cigarette manufacturing machine to a filter assembly machine.

More specifically, the term "dual rod cigarette manufacturing machine" is intended to mean a cigarette manufacturing machine of the type described, for example, in U.S. Pat. No. 4,418,705, which provides for supplying a filter assembly machine with two continuous cigarette rods traveling in an axial direction at substantially constant speed.

At the output of the dual rod cigarette manufacturing machine, both the continuous rods are cut by the same cutting head into normally "double" cigarette portions, i.e. portions twice the length of those which, when joined to a respective filter, go to form a normal filter-tipped cigarette.

When cut, the double cigarette portions, pushed from behind by the respective continuous rods, continue traveling axially into a pickup position in which they engage transfer members interposed between the output of the manufacturing machine and an input device of the filter assembly machine. The filter assembly machine input device is normally defined by a roller which is normally mounted for rotation about an axis parallel to the continuous rods, and presents a succession of peripheral seats parallel to the rods and traveling transversely with the roller about said axis.

Known transfer members for transferring the cigarette portions from the manufacturing machine to the filter assembly machine are normally defined by a revolving platform presenting a number of arms, each of which is fitted on the end with a gondola for simultaneously picking up two side by side cigarette portions—each cut off a respective rod—and for transferring them parallel to themselves from the output of the manufacturing machine into respective seats on the input roller of the filter assembly machine, and along an arc of substantially 90° about an axis perpendicular to the rotation axis of the input roller.

Though highly efficient and reliable, known transfer devices of the above type are invariably expensive and difficult to produce and set up, mainly on account of the high output capacity of modern machines (roughly 10–12,000 cigarettes a minute).

SUMMARY OF THE INVENTION

It is an object of the present invention to provide a unit for transferring cigarette portions from a dual rod cigarette manufacturing machine to a filter assembly machine, which is relatively straightforward in design and relatively cheap to produce.

According to the present invention, there is provided a unit for transferring cigarette portions from a dual rod cigarette manufacturing machine to a filter assembly machine, the unit comprising conveyor means traveling in a first direction and presenting seats for receiving respective said cigarette portions, said seats being oriented in a second direction crosswise to said first direction; a loading station through which each said seat travels in said first direction, and at which each said seat receives a respective said cigarette portion; and transfer means facing said loading station, and which provide for successively receiving from said manufacturing machine pairs of first and second said cigarette portions arranged side by side and parallel to said second direction, and for transferring them to the loading station and into respective said seats; characterized in that said conveyor means present a number of first said seats and a number of second said seats, for respectively receiving said first and said second cigarette portions at the loading station; said transfer means comprising launching means for successively receiving said pairs of first and second cigarette portions, and for simultaneously feeding the two cigarette portions in each said pair substantially in said second direction and to the loading station in time with the respective said seats.

The above unit preferably also comprises guide means for guiding the first and the second cigarette portion in each pair along respective first and second axial paths extending substantially in said second direction and substantially defining a plane, preferably a substantially horizontal plane, extending through said launching means and said loading station.

According to a preferred embodiment of the above transfer unit, said conveyor means comprise a first and a second roller respectively presenting said first and said second seats and respectively tangent to the first and the second path at the loading station.

According to a further preferred embodiment of the above transfer unit, said conveyor means comprise a single roller presenting alternating said first and second seats; said single roller being tangent to both said paths at said loading station.

BRIEF DESCRIPTION OF THE DRAWINGS

A number of non-limiting embodiments of the present invention will be described by way of example with reference to the accompanying drawings, in which.

Figure 1:
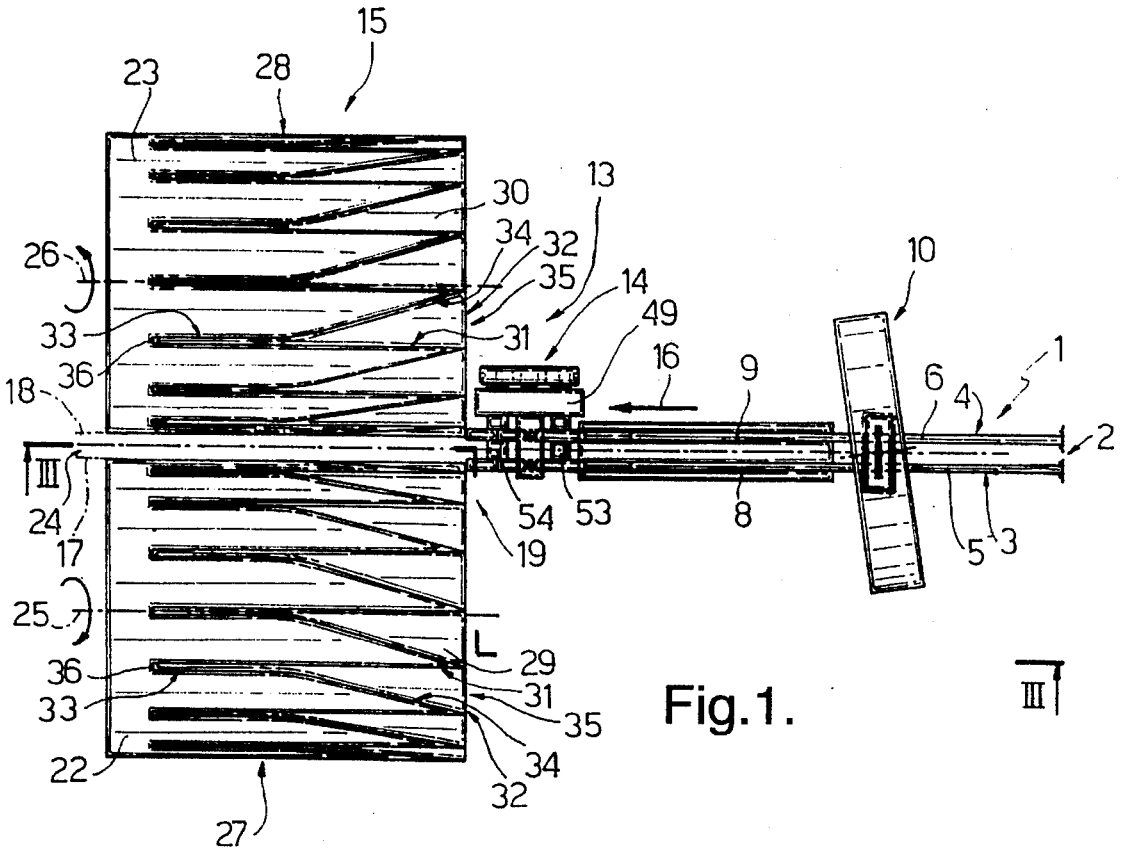
FIG. 1 shows a plan view of a first detail of a first preferred embodiment of the transfer unit according to the present invention.
Figure 5:
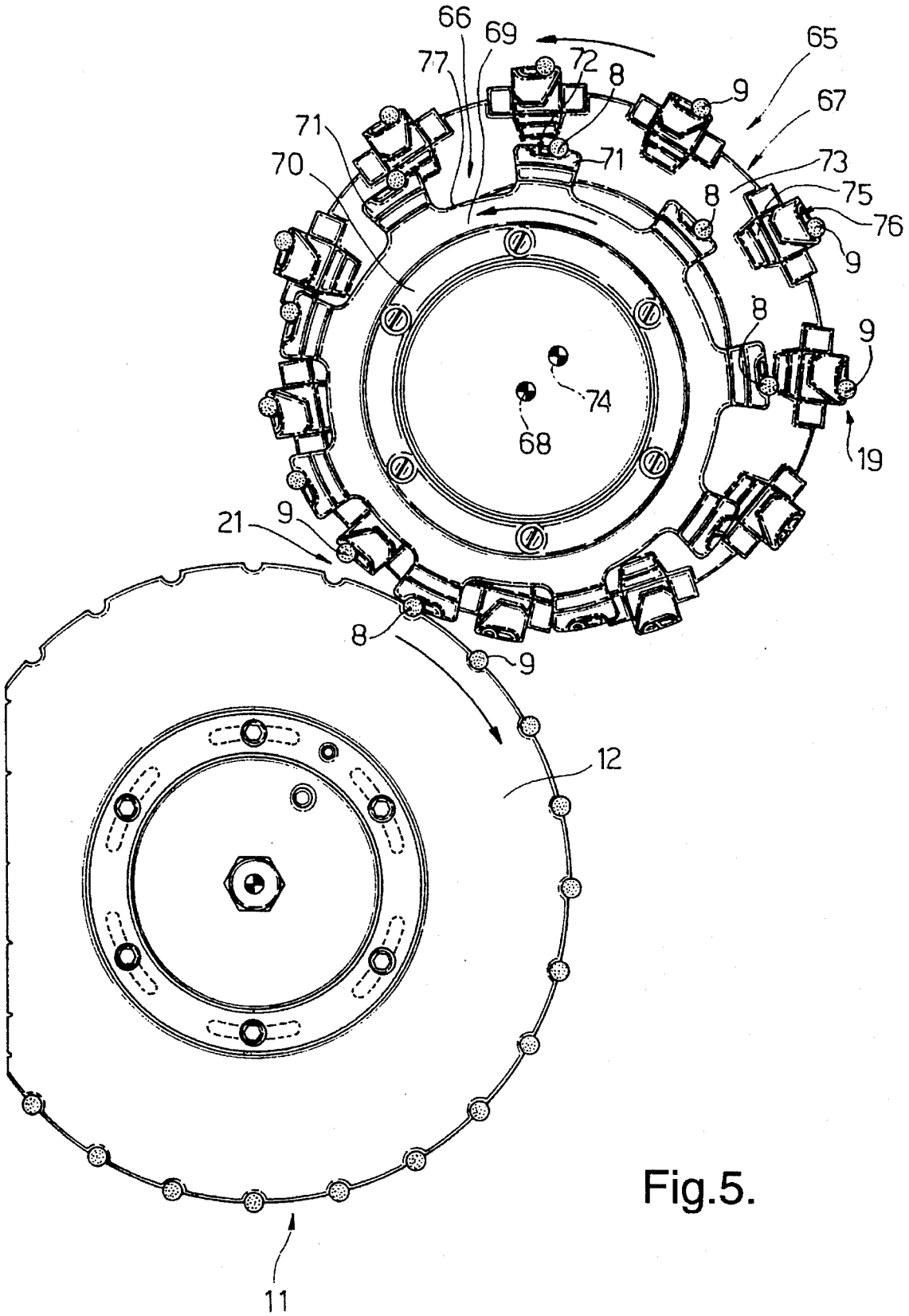
Figure 6:
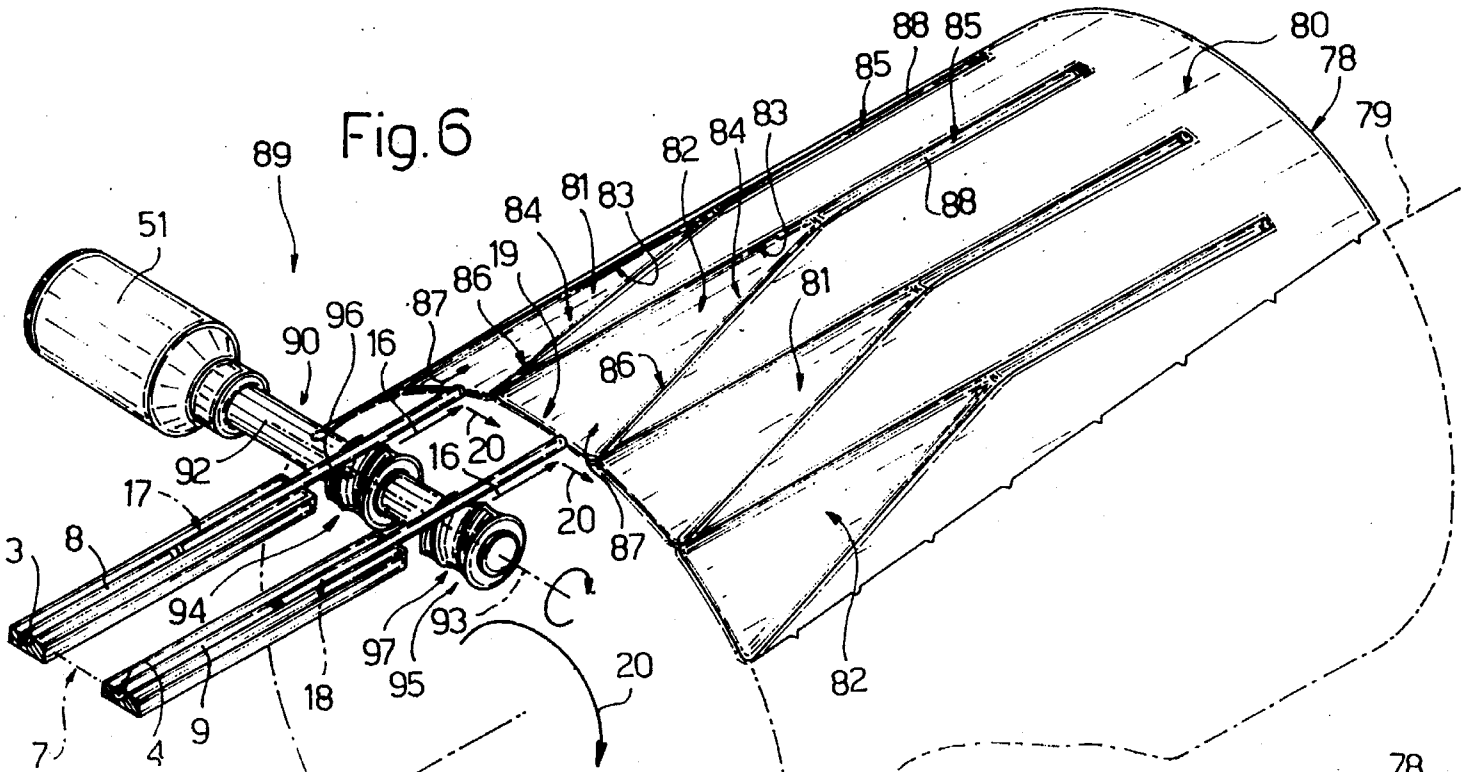
Figure 7:
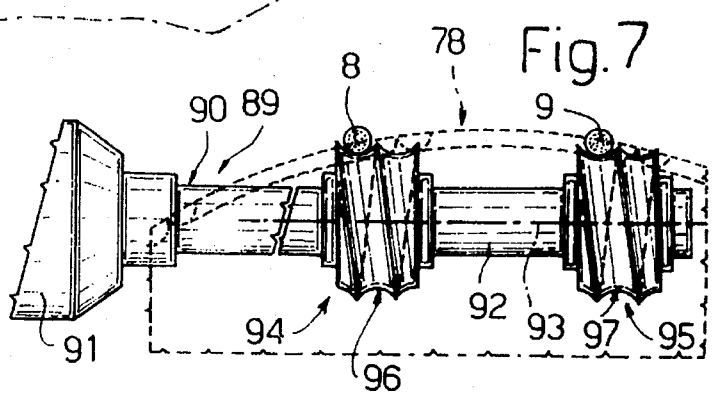

FIGS. *4a–4e* show a larger-scale, schematic view of the operating sequence of a detail of the FIG. 1 unit;

FIG. 5 shows a partially sectioned, front view of a second preferred embodiment of the transfer unit according to the present invention;

FIG. 6 shows a view in perspective of a third preferred embodiment of the transfer unit according to the present invention;

FIG. 7 shows a front view of a detail of the FIG. 6 embodiment.

DETAILED DESCRIPTION OF THE INVENTION

Figure 3:
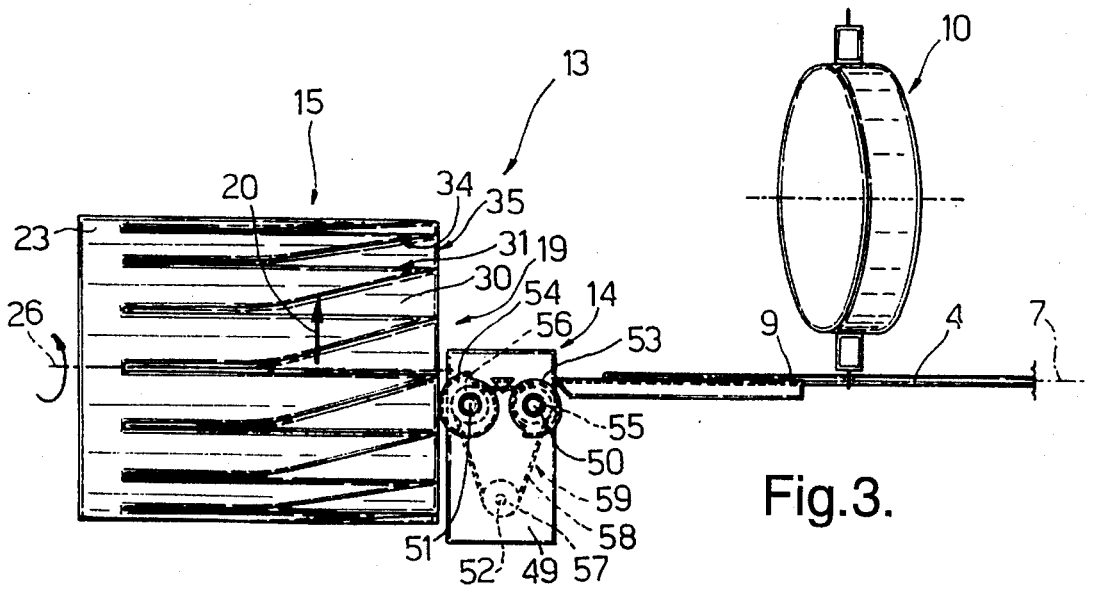
FIG. 3 shows a section along line III—III in FIG. 1.

With reference to FIGS. 1 and 3, number 1 indicates a dual rod cigarette manufacturing machine of the type described and illustrated in U.S. Pat. No. 4,418,705 to which full reference is made herein in the interest of full disclosure.

Machine 1 comprises a substantially horizontal output beam 2 with two longitudinal grooves 3 and 4 along which are fed, at the same substantially constant axial speed, two continuous cigarette rods 5 and 6, the axes of which define a substantially horizontal plane 7. As they travel along beam 2, rods 5 and 6 are cut into respective successions of respective cigarette portions 8 and 9 by a known rotary cutting head 10, the cutting speed of which is such as to form double cigarette portions 8 and 9, i.e. twice as long as the tobacco-filled portion of the filter-tipped cigarettes (not shown) being produced.

Figure 2:
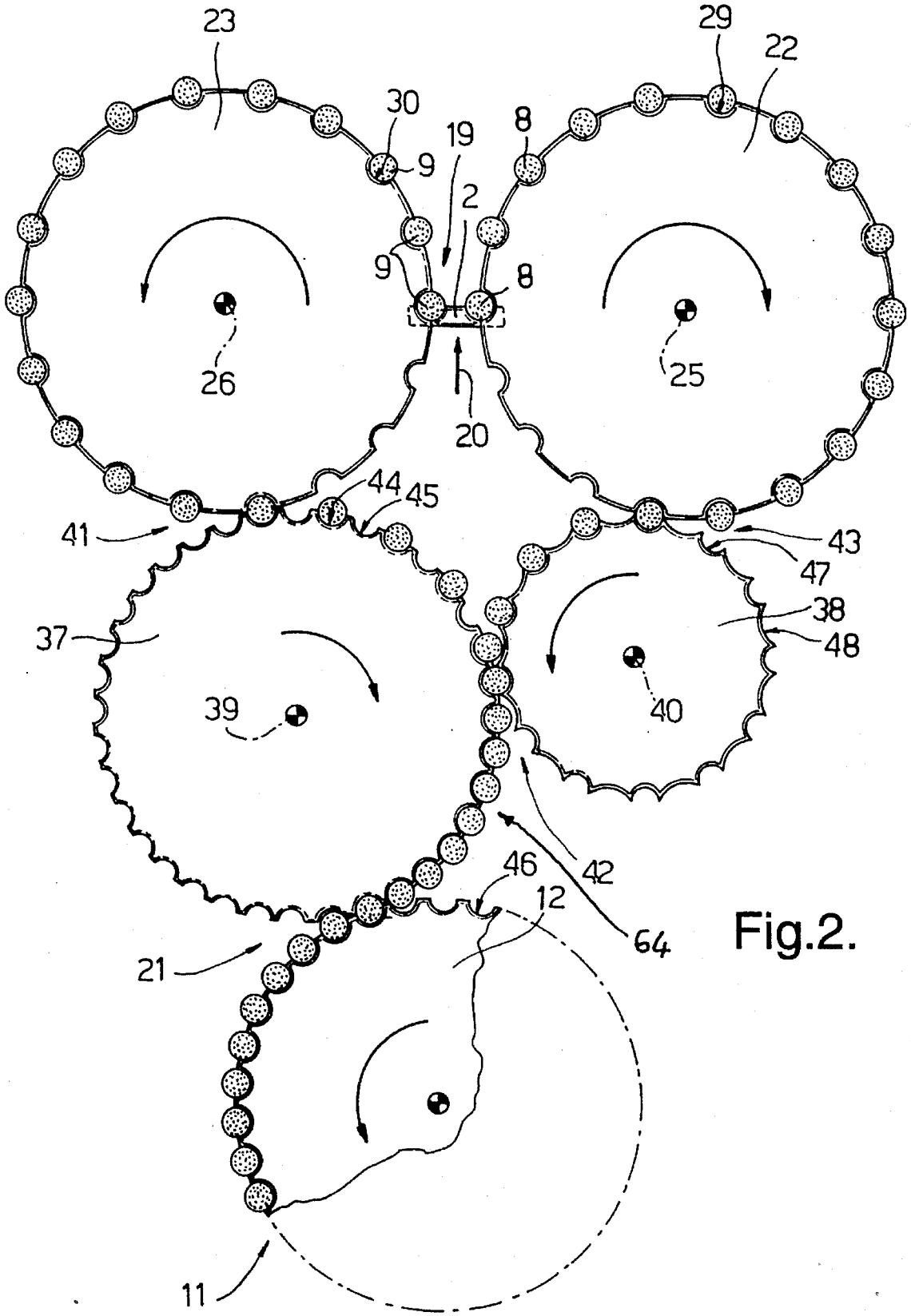
FIG. 2 shows a larger-scale, schematic front view of a second detail of the transfer unit in FIG. 1.

Number 11 in FIG. 2 indicates a filter assembly machine, the input roller 12 of which is connected to the output beam 2 of machine 1 by a transfer unit 13 comprising a launching device 14 facing and adjacent to the output end of beam 2, and a conveyor assembly 15. Device 14 provides for receiving portions 8 and 9 traveling along respective grooves 3 and 4 in direction 16, and for launching them, along respective paths 17 and 18 parallel to direction 16 and substantially coplanar with plane 7, to a loading station 19 where they are loaded on to assembly 15; which assembly 15 provides for receiving portions 8 and 9 at loading station 19, and for transferring them, in a direction 20 crosswise to direction 16 and to portions 8 and 9, to an unloading station 21 where they are unloaded on to roller 12.

As shown in FIGS. 1 and 2, assembly 15 comprises two counter-rotating rollers 22 and 23 located on either side of a strip 24 defined in plane 7 by paths 17 and 18, and which rotate about respective axes 25 and 26 substantially extending on plane 7 and parallel to direction 16.

In connection with plane 7 and said position of axes 25 and 26 "substantially coplanar with plane 7", it should be pointed out that, as shown more clearly later on, axes 25 and 26 are parallel to direction 16, but are in actual fact parallel to and slightly raised in relation to plane 7.

Rollers 22 and 23 present respective peripheral surfaces 27 and 28 substantially tangent to respective paths 17 and 18, and presenting respective numbers of seats 29 and 30 parallel to respective axes 25 and 26 and equally spaced about respective surfaces 27 and 28. By means of a known drive device (not shown), rollers 22 and 23 are rotated about respective axes 25 and 26 in time with each other and in such directions that, in use, each seat 29 and the corresponding seat 30 travel upwards in direction 20 through plane 7 and are respectively aligned with paths 17 and 18 at loading station 19.

As shown in FIGS. 1 and 2, each seat 29, 30 is a suction seat presenting (in direction 20) a rear lateral edge 31 parallel to plane 7, and a front edge 32; which front edge 32 presents a straight portion 33 parallel to edge 31, and a second straight portion 34 sloping frontwards in relation to edge 31 to define, on respective seat 29, 30, a flared inlet 35 facing launching device 14, and an end portion 36 of constant width roughly equal to but no smaller than the diameter of portions 8 and 9.

In addition to rollers 22 and 23, assembly 15 also comprises a further two rollers 37 and 38; roller 37 being mounted so as to rotate clockwise (in FIG. 2) about an axis 39 parallel to axis 26, in the opposite direction to roller 23, and at the same surface speed as rollers 23 and 12; and roller 38 being mounted so as to rotate anticlockwise (in FIG. 2) about an axis 40 parallel to axis 25, in the opposite direction to roller 22, and at the same surface speed as rollers 22 and 37. More specifically, roller 37 is tangent to roller 23 at a transfer station 41, is tangent to roller 38 at a loading station 42 downstream from station 41 in the rotation direction of roller 37, and is tangent to roller 12 at station 21 downstream from station 42 in the rotation direction of roller 37; while roller 38 is tangent to roller 22 at a transfer station 43, and is tangent to roller 37 at station 42 downstream from station 43 in the rotation direction of roller 38. Finally, roller 37 presents two numbers of suction seats 44 and 45 arranged alternately to form a single succession of seats with the same spacing as a succession of suction seats 46 on roller 12, and with half the spacing of seats 30; and roller 38 presents two numbers of seats 47 and 48—of which only seats 47 are suction types—arranged alternately to form a single succession of seats with the same spacing as seats 46, and with half the spacing of seats 29. In use, seats 44 rotate in time with seats 30, with seats 48, and with respective seats 46, while seats 47 rotate in time with seats 29, with seats 45, and with respective seats 46 alternating with those in time with seats 44.

Launching device 14 comprises a plate 49 extending vertically through plane 7 in the gap between the output end of beam 2 and loading station 19, and which supports for rotation three horizontal shafts 50, 51, 52 extending through plate 49, parallel to and beneath plane 7, and crosswise to direction 16. Shafts 50 and 51 are located side by side and the same distance from plane 7, and are fitted at one end with two suction rollers 53 and 54, and at the other end with two pulleys 55 and 56 on the opposite side of plate 49 to respective rollers 53 and 54. Shaft 52 is a drive shaft located beneath and in an intermediate position in relation to shafts 50 and 51, and is fitted with a pulley 57 which, together with pulleys 55, 56 and a belt 58, forms a drive 59 for rotating rollers 53 and 54 anticlockwise in FIGS. 3 and 4.

Each roller 53, 54 presents a lateral surface 60, 61 shaped like a portion of a spiral extending over an arc of 360°, and wherein the minimum- and maximum-radius generating lines in the same diametrical plane are connected by a shoulder 62, 63 in the diametrical plane itself. Rollers 53 and 54 are offset in relation to each other by an arc depending on the distance of shafts 50 and 51, and present different radial dimensions. More specifically, roller 54 between loading station 19 and roller 53 presents radial dimensions greater than those of roller 53 and such that the radius of the lesser-radius generating line of roller 53 equals the distance between the axes of shafts 50, 51 and the continuation of the bottom of grooves 3 and 4. Rollers 53 and 54 are also so offset in relation to each other that, when shoulder 63 of roller 54 is positioned perpendicular to and through plane 7, roller 53 is so positioned angularly that the distance between its greater generating line and the axis of shaft 50 equals the lesser radius of roller 54. Finally, rollers 53 and 54 rotate at constant angular speeds in time with cutting head 10 and rollers 22, 23, and present surface speeds varying with their radius and such that their mean peripheral speeds are slightly greater than the traveling speed of rods 5 and 6, so that each portion 8, 9 reaches roller 53 with its front end contacting shoulder 62, and, on leaving roller 54, is substantially coplanar with the rear edge 31 of a respective seat 29, 30.

Figure 4A:
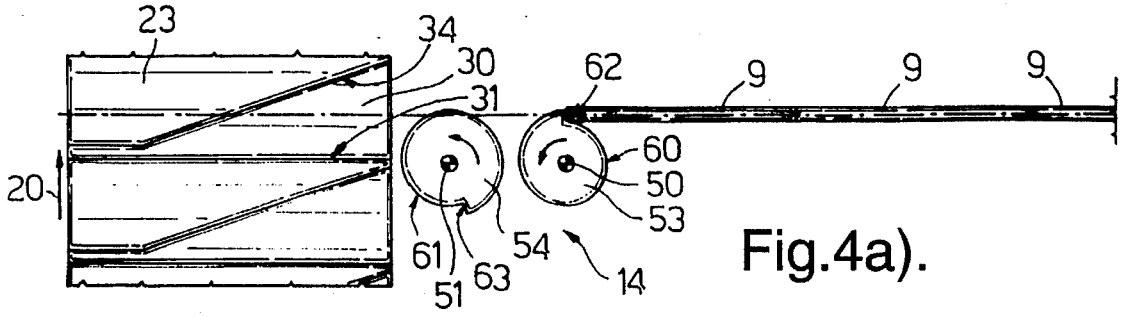
Figure 4B:
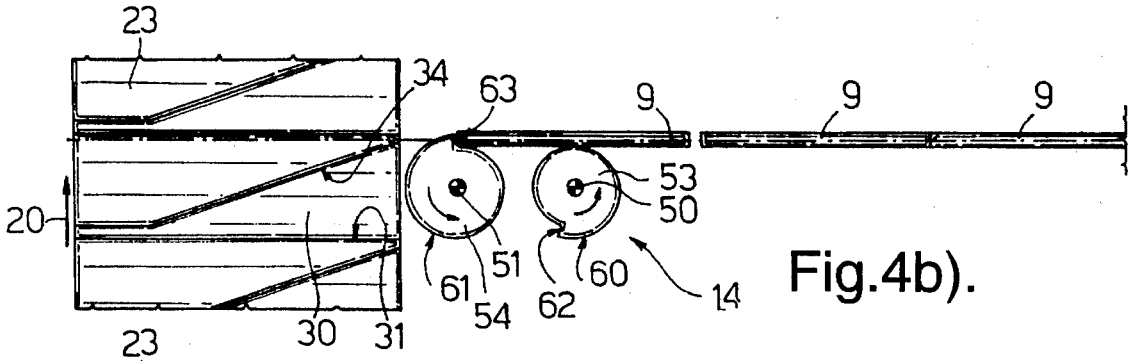

In use, each cigarette portion 8, 9, pushed by respective continuous cigarette rod 5, 6, travels at a substantially constant first speed along beam 2 downstream from cutting head 10, and, on reaching the free end of beam 2, moves forward into contact with the periphery of roller 53. More specifically, and as shown in FIG. 4*a*, on reaching roller 53, the front end of each portion 8, 9 contacts shoulder 62, the constant angular speed of which about the axis of shaft 50 is such that shoulder 62 makes one complete turn in the time taken by portion 8, 9, at said first speed, to cover a distance equal to its own length. Each portion 8, 9 is then retained by suction on roller 53 by which it is fed towards roller 54 which cooperates with roller 53 to launch portion 8, 9 into a respective seat 29, 30. More specifically, on account of the spiral shape of lateral surfaces 60 and 61, which form two (partially superimposed) portions of the same spiral, and the constant angular speed of rollers 53 and 54, portion 8, 9 is fed forward by rollers 53 and 54 at a speed which increases substantially linearly for as long as portion 8, 9 is engaged by device 14.

In connection with the above, it should be pointed out that, being spiral-shaped, rollers 53 and 54 impart to each portion 8, 9 a transverse speed component which, if surfaces 60 and 61 are calculated correctly, presents substantially the same value as the surface speed of rollers 22 and 23, so that portion 8, 9 is detached from plane 7 by a value substantially equal to the distance of plane 7 from axes 25 and 26.

Figure 4C:
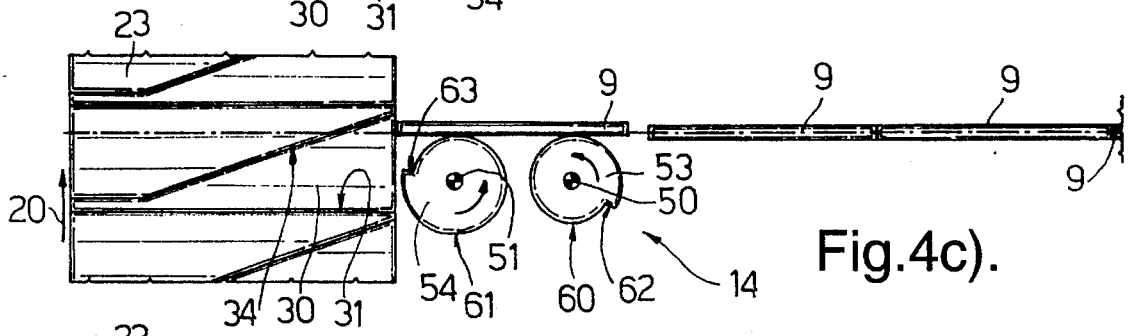
Figure 4D:
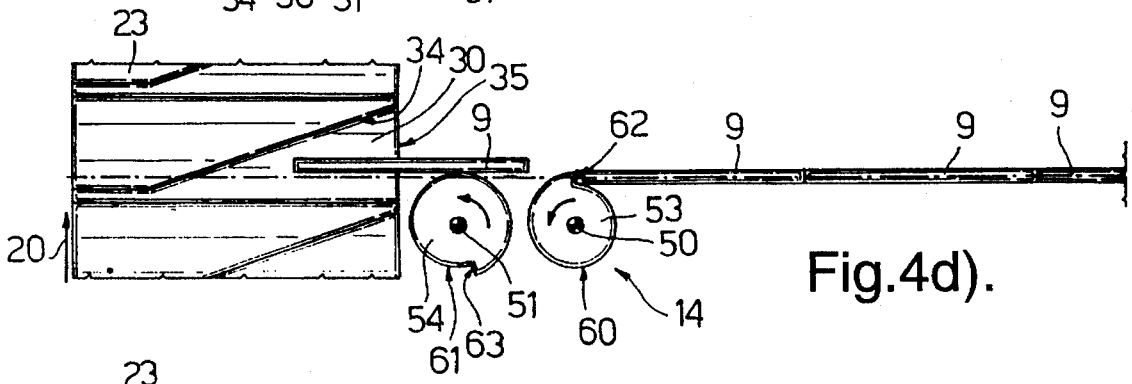
Figure 4E:
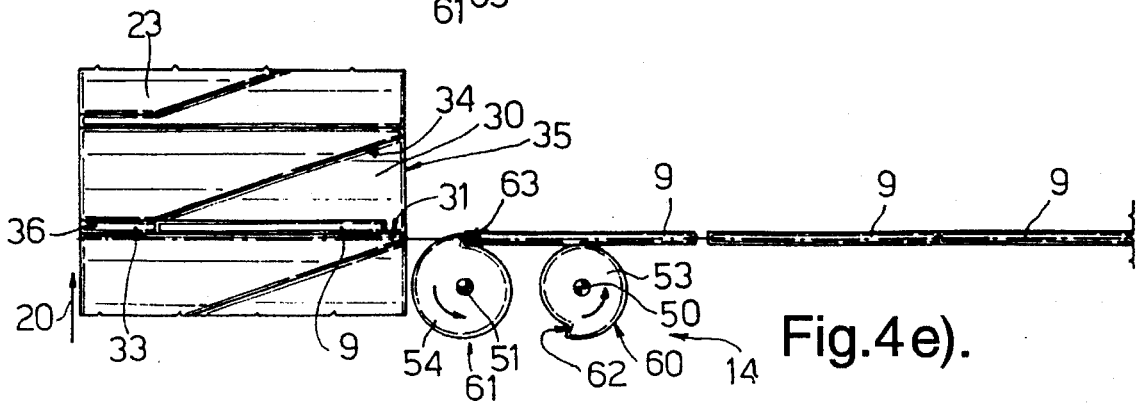

As shown in FIG. 4*d*, each portion 8, 9 fed forward by roller 54 penetrates inside inlet 35 of respective seat 29, 30. More specifically, and as shown in FIGS. 4*c* and 4*e*, on reaching respective roller 22, 23, each portion 8, 9 is positioned with its end facing the front end of inlet 35 of respective seat 29, 30 adjacent to portion 34 of front edge 32, and is fully inserted inside respective seat 29, 30 before being reached by respective rear edge 31 on to which it comes to rest with a relative transverse speed of substantially zero by virtue of the transverse acceleration imparted to portion 8, 9 by spiral-shaped surfaces 60 and 61.

Subsequently, each portion 8 in a respective seat 29 is transferred to a seat 47 on roller 38 at station 43, and by roller 38 to a seat 45 on roller 37 at station 42. Similarly, each portion 9 in a respective seat 30 is transferred to a seat 44 on roller 37 at station 41.

Downstream from loading station 42, therefore, all the seats 44 and 45 on roller 37 are occupied, and alternating portions 8 and 9 form a single succession 64 of equioriented, transversely aligned portions, which is transferred to roller 12 at station 21.

In the FIG. 5 embodiment, assembly 15 interposed between launching device 14 and the input roller 12 of filter assembly machine 11 is replaced by an assembly 65, which comprises two rollers 66 and 67 rotating at the same surface speed, and which provide for feeding portions 8 and 9 to roller 12 by transferring them simultaneously from loading station 19 directly to unloading station 21. Roller 66 is substantially cylindrical, rotates at constant angular speed about an axis 68 parallel to direction 16, and comprises an outer jacket 69 mounted for rotation on an inner drum 70 forming, in known manner, a pneumatic distributor. Jacket 69 presents a number of axial ribs 71 extending radially outwards from it and each presenting a respective suction seat 72 similar to seats 29, 30 and communicating in known manner with said pneumatic distributor to receive a respective cigarette portion 8. As roller 66 rotates about axis 68, each seat 72 travels through plane 7 at station 19, moving in direction 20 crosswise to plane 7 and portions 8, 9.

Roller 67 is substantially in the form of a cylindrical cage, and comprises a substantially cylindrical platform 73 with a larger radius than roller 66, and rotating about an axis 74 parallel to but offset laterally in relation to axis 68. Platform 73 is positioned facing the end surface of roller 66, and supports a number of columns 75, each presenting a respective axial groove forming a respective seat 76 similar to seats 29, 30 and communicating in known manner with a suction system to receive a respective cigarette portion 9.

Columns 75 are arranged about the periphery of platform 73 with the same spacing as seats 76, and are so shaped and sized as to fit inside respective grooves 77 defined on the periphery of roller 66 by respective pairs of adjacent ribs 71. As rollers 66 and 67 rotate anticlockwise (in FIG. 5), seats 72 and 76 travel along respective circular paths tangent to each other at unloading station 21, and which intersect plane 7 at side by side points along paths 17 and 18. Each seat 72 travels through plane 7 simultaneously with a corresponding seat 76 so as to simultaneously pick up a pair of portions 8 and 9 from plane 7 in the same way as seats 29 and 30; and seats 72 and 76 are offset half a space in relation to each other at station 21 so as to define, at station 21, a single succession of seats with the same spacing as and in time with seats 46, and so transfer portions 8 and 9 directly to roller 12.

According to the FIGS. 6 and 7 embodiment, assembly 15 of machine 11 is replaced by a single roller 78 similar to one of rollers 22 and 23, and which, by means of a known drive device (not shown), is rotated clockwise (in FIG. 6) about its axis 79 parallel to direction 16, directly beneath plane 7, and substantially beneath continuous rod 6. Roller 78 presents a peripheral surface 80 tangent to plane 7 at loading station 19 and to roller 12 at unloading station 21, and presenting two successions of equally spaced, alternating seats 81 and 82 parallel to axis 79. Each seat 81 is separated from each adjacent seat 82 by a distance equal to that between grooves 3 and 4 and to that between adjacent seats on roller 12.

As shown in FIGS. 6 and 7, each seat 81, 82 is a suction seat presenting a rear lateral edge 83 (in direction 20) parallel to axis 79, and a front edge 84 in turn presenting a straight portion 85 parallel to axis 79, and a second straight portion 86 angled frontwards in relation to edge 83 so as to define, on seat 81, 82, a flared inlet 87 facing beam 2, and an end portion 88 of constant width approximately equal to but no less than the diameter of cigarette portions 8 and 9.

In the FIGS. 6 and 7 embodiment, transfer unit 13 is replaced by a unit 89 comprising launching device 90, which in turn comprises a motor 91 mounted in a fixed position to the side of paths 17 and 18 and presenting an output shaft 92 rotating clockwise (in FIG. 6) about its axis 93 extending beneath and parallel to plane 7 and crosswise to paths 17 and 18. Shaft 92 is fitted with two launching rollers 94 and 95 substantially tangent to plane 7, and each presenting a respective helical suction groove 96, 97, the start of which is aligned with respective path 17, 18 in time with the arrival of a respective cigarette portion 8, 9.

The surface speed of rollers 94 and 95 is at least equal to, and preferably slightly greater than, the traveling speed of cigarette portions 8 and 9, and the pitch of grooves 96 and 97 is such that respective portions 8 and 9 engaged inside them present a transverse speed, in direction 20, substantially equal to the surface speed of roller 78.

In actual use, each portion 8, 9 is fed forward by respective roller 94, 95 into inlet 87 of respective seat 81, 82. More specifically, on reaching roller 78, the end of each portion 8, 9 is positioned facing the front end of inlet 87 of respective seat 81, 82, adjacent to portion 26 of respective front edge 84, and is inserted fully into to respective seat 81, 82 prior to the arrival of respective rear edge 83 against which it comes to rest with a relative transverse speed of substantially zero on account of the transverse acceleration imparted to portion 8, 9 by helical groove 96, 97.

We claim:

1. A unit 13; 89 for transferring cigarette portions 8, 9 from a dual rod cigarette manufacturing machine 1 to a filter assembly machine 11, the unit 13; 89 comprising conveyor means 15; 65; 78 traveling in a first direction 20 and presenting seats 29, 30; 72, 76; 81, 82 for receiving respective said cigarette portions 8, 9, said seats 29, 30; 72, 76; 81, 82 being oriented in a second direction 16 crosswise to said first direction 20; a loading station 19 through which each said seat 29, 30; 72, 76; 81, 82 travels in said first direction 20, and at which each said seats 29, 30; 72, 76; 81, 82 receives a respective said cigarette portion 8, 9; and transfer means 14; 90 facing said loading station 19, and which provide for successively receiving from said manufacturing machine 1 pairs of first 8 and second (9) said cigarette portions arranged side by side and parallel to said second direction 16, and for transferring them to the loading station 19 and into respective said seats 29, 30; 72, 76; 81, 82; characterized in that said conveyor means 15; 65; 78 present a number of first said seats 29; 72; 81 and a number of second said seats 30; 76; 82, for respectively receiving said first 8 and said second 9 cigarette portions at the loading station 19; said transfer means 14; 90 comprising launching means 14; 90 for successively receiving said pairs of first 8 and second 9 cigarette port ions, and for simultaneously feeding the two cigarette portions 8, 9 in each said pair substantially in said second direction 16 and to the loading station 19 in time with the respective said seats 29, 30; 72, 76; 81, 82.

2. A unit as claimed in claim 1, characterized in that it also comprises guide means 3, 4 for guiding the first and second cigarette portion 8, 9 in each pair along respective first 17 and second 18 axial paths extending substantially in said second direction 16 and substantially defining a plane 7 extending through said launching means 14 and said loading station 19.

3. A unit as claimed in claim 2, characterized in that said plane 7 is substantially horizontal.

4. A unit as claimed in claim 2 characterized in that said conveyor means 15; 65 comprise a first 22; 66 and second 23; 67 roller respectively presenting said first 29; 72 and second 30; 76 seats and respectively tangent to the first 17 and second 18 path at said loading station 19.

5. A unit as claimed in claim 4, characterized in that said first 22 and second 23 rollers are two rollers mounted for rotation in opposite directions about respective axes 25, 26 parallel to each other and on either side of a strip 24 defined in said plane 7 by said first 17 and second 18 axial paths.

6. A unit as claimed in claim 5, characterized in that said axes 25, 26 are substantially located in said plane 7.

7. A unit as claimed in claim 4, characterized in that said first 66 and second 67 rollers are two rollers mounted for rotation in the same direction about respective axes 68, 74 parallel to each other and on the same side of a strip 24 defined in said plane 7 by said first 17 and second 18 axial paths.

8. A unit as claimed in claim 7, characterized in that said first 72 and second 76 seats travel along respective circular paths tangent to each other, located one inside the other, and which intersect said plane 7 at side by side points along respective said first 17 and second 18 axial paths.

9. A unit as claimed in claim 8, characterized in that said first 72 and second 76 seats present the same spacing, are offset in relation to each other by half a space at the point of tangency of the respective said circular paths, and are in time with each other at the point at which the circular paths intersect said plane 7.

10. A unit as claimed in claim 2, characterized in that, for each cigarette portion 8; 9 in each said pair, said launching means 14 comprise two launching rollers 53, 54 coplanar with the same said axial path 17; 18 and presenting respective axes 50, 51 parallel to said plane 7 and crosswise to said second direction 16; and drive means 59 for rotating the two launching rollers 53, 54 in the same direction and at the same angular speed about their respective said axes 50, 51; said rollers 53, 54 being located on the same side of the respective said axial path 17; 18, and presenting respective spiral-shaped peripheral surfaces 60; 61.

11. A unit as claimed in claim 10, characterized in that each roller 53; 54 in each pair of launching rollers 53, 54 rotates in time with the corresponding launching roller 53; 54 in the other pair.

12. A unit as claimed in claim 11, characterized in that each said spiral-shaped peripheral surface 60; 61 is in the form of a portion of a spiral extending about an arc of 360° and wherein the minimum- and maximum-radius generating lines in the same diametrical plane are connected by a shoulder 62; 63 in the diametrical plane itself.

13. A unit as claimed in claim 12, characterized in that, in each pair of launching rollers 53, 54, the front roller 54 in said second direction 16 presents greater radial dimensions; the rollers 53, 54 in each pair of launching rollers being offset in relation to each other by an arc depending on the distance of the respective said axes 50, 51.

14. A unit as claimed in claim 2 characterized in that said conveyor means 78 comprise a single roller 78 presenting alternating said first and second seats 81, 82; said single roller 78 being substantially tangent to said paths 17, 18 at said loading station 19.

15. A unit as claimed in claim 14, characterized in that said launching means 90 comprise, for each cigarette portion 8, 9 in each said pair of cigarette portions 8, 9, a launching roller 94; 95 substantially tangent to a respective said axial path 17; 18 and presenting an axis 93 parallel to said plane 7 and crosswise to said second direction 16; and drive means 91, 92 for rotating said launching roller 94; 95 about said axis 93 so that the roller 94; 95 presents a surface speed equal to the traveling speed of the respective cigarette portion 8, 9 along the respective said path 17; 18; each said launching roller 94; 95 presenting a respective helical groove 96; 97, the start of which is alignable with the respective said path 17; 18.

* * * * *